US005294365A

United States Patent [19]

Welch et al.

[11] Patent Number: 5,294,365

[45] Date of Patent: Mar. 15, 1994

[54] HYDROXYPOLYETHERS AS LOW-FOAM SURFACTANTS

[75] Inventors: Michael C. Welch, Woodhaven; Jay G. Otten, Flat Rock; Glenis R. Schenk, Wyandotte, all of Mich.

[73] Assignee: BASF Corporation, Parsippany, N.J.

[21] Appl. No.: 806,028

[22] Filed: Dec. 12, 1991

[51] Int. Cl.[5] ..... C11D 1/72; C11D 3/075

[52] U.S. Cl. ..... 252/174.21; 252/174.22; 252/DIG. 2; 252/DIG. 6; 568/613; 568/618; 568/623

[58] Field of Search ..... 568/625, 624, 613, 623, 568/618; 252/DIG. 6, 174.21, 174.15, 174.17, 546, DIG. 2, DIG. 12, DIG. 15; 514/844

[56] References Cited

U.S. PATENT DOCUMENTS

| | | | |
|---|---|---|---|
| 4,600,523 | 7/1986 | Piorr et al. | 252/174.22 |
| 4,719,044 | 1/1988 | Piorr et al. | 252/548 |
| 4,898,621 | 2/1990 | Pruehs et al. | 134/25.2 |
| 4,898,992 | 2/1990 | Stankowiak et al. | 568/618 |
| 4,913,833 | 4/1990 | Otten et al. | 252/99 |
| 4,925,587 | 5/1990 | Schenker et al. | 252/174.22 |
| 4,931,218 | 6/1990 | Schenker et al. | 252/551 |

*Primary Examiner*—Anthony McFarlane
*Assistant Examiner*—P. Achutamurthy

[57] ABSTRACT

Hydroxypolyethers as low foam surfactants comprising a compound of the general formula $$R^1[O(CH_2CH_2O)_n(CH_2\overset{CH_3}{\overset{|}{C}}HO)_m]CH_2\overset{OH}{\overset{|}{C}}HCH_2OR^2,$$

wherein $R^1$, $R^2$ are the same or different and are a linear or branched $C_1$- to $C_{18}$-alkyl radical;

n is a number of from 15 to 45; and m is a number of from 0 to 3.

These compounds are useful in cleaning compositions and rinse aids, especially in automatic dishwashing machines.

10 Claims, No Drawings

HYDROXYPOLYETHERS AS LOW-FOAM SURFACTANTS

FIELD OF THE INVENTION

The present invention is directed to hyroxypolyethers obtainable by the addition of an alkyl glycidyl ether to a polyoxyalkylene polyether. The hydroxypolyethers of the present invention are useful as low-foaming, biodegradable surfactants in cleaning compositions and rinse aids.

BACKGROUND OF THE INVENTION

Nonionic surfactants based on polyoxyalkylene polyether derivatives are known in the art. These surfactants are used in cleaning compositions for cleaning hard surfaces, particularly for cleaning tableware and other utensils in machine dishwashers. The requirements for these nonionic surfactants are good cleaning, spotting and filming prevention, and good defoaming properties along with biodegradability.

In the U.S. Pat. No. 4,913,833 an automatic dishwashing detergent composition is disclosed comprising an active-chlorine compound and a sterically hindered epoxide-capped polyether polyol as a nonionic surfactant.

The U.S. Pat. No. 4,925,587 discloses specified derivatives of hydroxyalkyl polyalkylene glycol ethers for aqueous cleaning preparations for industrial and institutional purposes.

The U.S. Pat. No. 4,898,621 discloses a process of rinsing dishes and glassware in a dishwashing machine comprising a hydroxyalkyl polyethylene glycol ether. This patent is limited to the use of derivatives of polyethylene glycol ethers.

Some of these nonionic surfactants show improved results as foam-inhibiting agents but these properties are not fully sufficient for all cleaning applications.

Therefore, it was an object of the present invention to provide a nonionic surfactant for the use in cleaning compositions which show good cleaning properties, is low-foaming and in addition is biodegradable.

SUMMARY OF THE INVENTION

The object of the present invention has been achieved with a compound of the general formula $$R^1[O(CH_2CH_2O)_n(CH_2\overset{\overset{\displaystyle CH_3}{|}}{C}HO)_m]CH_2\overset{\overset{\displaystyle OH}{|}}{C}HCH_2OR^2 \qquad \text{I}$$

$R^1$, $R^2$ are the same or different and are a linear or branched $C_1$-to $C_{18}$-alkyl radical;

n is a number of from 15 to 45; and m is a number of from 1 to 3.

DETAILED DESCRIPTION OF THE INVENTION

The nonionic surfactants of the present invention are compounds of the general formula I.

$$R^1[O(CH_2CH_2O)(CH_2\overset{\overset{\displaystyle CH_3}{|}}{C}HO)_m]CH_2\overset{\overset{\displaystyle OH}{|}}{C}HCH_2OR^2 \qquad \text{I}$$

wherein $R^1$, $R^2$ are the same or different and are linear or branched $C_1$- to $C_{18}$-alkyl radicals;

n is a number of from 15 to 45; and m is a number of from 1 to 3.

Preferred are compounds of the formula I wherein $R^1$, $R^2$ are linear or branched $C_6$- to $C_{18}$-alkyl radicals n is a number of from 15 to 20; and m is a number of from 1 to 3.

Most preferred are compounds, wherein $R^1$, $R^2$ are different radicals and are linear or branched $C_{10}$- to $C_{15}$-alkyl radicals;

n is a number of from 15 to 20; and m is a number of from 1 to 3.

Suitable $R^1$ substituents include linear or branched radicals like methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, and the like.

Suitable $R^2$ substituents include linear or branched radicals like methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl and the like.

For the preparation of the compound of the general formula I the related monoalkyl ether is reacted with an alkyl glycidyl ether in the presence of an alkaline catalyst.

Suitable monoalkylethers of polyoxyalkylene glycols are monoalkylethers of polyethylenglycol or polyethylene polypropylene glycol in a molecular weight range of from about 300 to about 10,000, preferably from about 600 to about 2,000.

The polyethylene polypropylene glycol monoalkyl ether is prepared by the reaction of a linear or branched $C_1$- to $C_{18}$-alcohol, preferably $C_6$- to $C_{18}$-alcohol or mixtures of these alcohols with first ethylene oxide followed by propylene oxide or with first propylene oxide, followed by ethylene oxide or with a mixture of ethylene oxide and propylene oxide. Another method of preparing the polyethylene polypropylene glycol monoalkyl ether is by capping polyethylene glycol monoalkyl ether with propylene oxide.

Suitable alcohols are methanol, ethanol, n-propanol, i-propanol, n-butanol, i-butanol, sec. butanol, n-decanol, i-decanol, n-undecanol, n-dodecanol, n-tridecanol, n-tetradecanol, n-pentadecanol, n-hexadecanol, n-heptadecanol, n-octadecanol, other branched isomers of these alkanols and mixtures thereof.

Suitable alkyl glycidyl ethers are methyl glycidyl ether, ethyl glycidyl ether, n-propyl glycidyl ether, n-butyl glycidyl ether, n-pentyl glycidyl ether, n-hexyl glycidyl ether, n-heptyl glycidyl ether, n-octyl glycidyl ether, n-nonyl glycidyl ether, n-decyl glycidyl ether, n-undecyl glycidyl ether, n-dodecyl glycidyl ether, n-tridecyl glycidyl ether, n-tetradecyl glycidyl ether, n-pentadecyl glycidyl ether, n-hexadecyl glycidyl ether, n-heptadecyl glycidyl ether, n-octadecyl glycidyl ether, and branched isomers of these alkyl glycidyl ethers like i-propyl glycidyl ether, i-butyl glycidyl ether, sec-butyl glycidyl ether and the like.

Preferred are n-octyl glycidyl ether, n-decyl glycidyl ether, and n-dodecyl glycidyl ether.

The alkyl glycidyl ethers may be prepared by reacting alcanols with epichlorhydrin in the presence of a base. Suitable alcohols for this reaction are methanol, ethanol, n-propanol, n-butanol, n-pentanol, n-hexanol, n-heptanol, n-octanol, n-nonanol, n-decanol, n-undecanol, n-dodecanol, n-tridecanol, n-tetradecanol, n-pentadecanol, n-hexadecanol, n-heptadecanol, n-octadecanol, branched isomers of these alkanols and mixtures thereof. Other synthetic routes to the alkyl glycidyl ether are within the spirit of this invention.

The reaction between the polyalkylene glycol monoalkylether and the alkyl glycidyl ether to form the compound of formula I takes place in the presence of an alkaline catalyst like alcohol alkoxylate or metal hydroxide like sodium hydroxide or potassium hydroxide. The molar ratio between the polyalkylene glycol monoalkyl ether and the alkyl glycidyl ether is in the range of from about 1.2 to about 1.0:1.

The reaction temperature is from about 100° to 200° C., preferably 120° to 180° C. for a time period of from about 1 to about 8 hours. The end of the reaction is determined by a low level of epoxy content. The resulting products are compounds of the Formula I.

The compounds of the present invention are useful in cleaning compositions and rinse aids for cleaning and rinsing of metal, glass, plastic and ceramic surfaces.

The cleaning compositions show good cleaning properties, are very low foaming and in addition the compounds of the general Formula I are biodegradable.

EXAMPLE 1

To a suitable reaction vessel was placed 240 grams of 800 MW (molecular weight) oxethylated $C_{12}$–$C_{15}$-alcohol (LIAL ® 125 alcohol) (Enichem Augusta Industriale) containing 3 moles propylene oxide, and 2.8 grams potassium t-butoxide. After 1 hour at 150° C., 43 grams of n-decyl glycidyl ether was added. Work-up gave 255 grams of a light brown liquid with the following properties:

Cloud Point of a 1% (by weight) aqueous solution: 21° C. Surface Tension of a 0.1% (by weight) aqueous solution:

| | |
|---|---|
| 28.2 dyne/cm | |
| Ross-Miles Foam Height: | Time = minutes, 10 mm. |
| | Time = 5 minutes, 1 mm. |

A. Test in a Standard Machine Dishwashing Detergent Formulation as a Cleaning Composition:

Machine Dishwashing Detergent formulation containing test surfactant:

| | WEIGHT % |
|---|---|
| Surfactant | 3.0 |
| Sodium tripolyphosphate hexahydrate | 44.0 |
| Sodium carbonate | 20.0 |
| Sodium metasilicate pentahydrate | 20.0 |
| Sodium sulfate | 11.5 |
| Chlorinated isocyanurate | 1.5 |

PROTEIN SOIL DEFOAMING TEST

TEST CONDITIONS:

Hobart ® UMP Dishwasher Temp. 120° F.

3 cycles/Surfactant

Cycle 1—no Soil

Cycle 2—Milk Soil

Cycle 3—Egg Soil 20 grams machine dishwashing detergent containing 3 WT % Surfactant Milk Soil—12 g CARNATION ® Brand Powdered Milk Egg Soil—15 g blended raw egg The detergent or detergent and soil are placed in the dishwasher. The spray arm rotation speed is measured during the wash cycle.

| SURFACTANT | | SPRAY ARM SPEED RPM | % EFFICIENCY VERSUS WATER BLANK | FOAM HEIGHT AT END OF WASH CYCLE |
|---|---|---|---|---|
| Example 1 | NO MILK | 64.0 | 100 | ¼" |
| | MILK SOIL | 63.5 | 99 | ¼" |
| | EGG SOIL | 61.5 | 96 | ¾" |

B. Test as a Rinse Aid

SPOTTING & FILMING PERFORMANCE

Hobart AM-11 Single Tank Commercial Dishwasher

Test conditions: wash 150°–160° F., rinse 180° F.

400 PPM rinse aid: 20% surfactant/2% MONAWET ® MM80 hydrotrope (sodium dihexyl sulfosuccinate)/78% water 2400 PPM chlorinated detergent 600 PPM 80% margarine / 20% powdered milk soil

| SAMPLE | WASH FOAM | RINSE FOAM | AVE. FILM/STREAK |
|---|---|---|---|
| No rinse aid | 1" | <¼" | 5.2 |
| Rinse aid of Example 1 | ¾" | ¼" | 2.8 |

1 = No Spots or Film,
>5 = Completely covered with spots and/or film

We claim:

1. A compound of the formula $$R^1[O(CH_2CH_2O)_n(CH_2\overset{CH_3}{\overset{|}{C}}HO)_m]CH_2\overset{OH}{\overset{|}{C}}HCH_2OR^2$$

wherein $R^1$, $R^2$ are the same or different and are a linear or branched $C_1$–to $C_{18}$-alkyl radical;

n is a number of from 15 to 45; and m is a number of from 1 to 3.

2. The compound according to claim 1, wherein $R^1$, $R^2$ are linear or branched $C_6$- to $C_{18}$-alkyl radicals.

3. The compound according to claim 1, wherein $R^1$, $R^2$ are linear or branched $C_{10}$- to $C_{15}$-alkyl radicals.

4. The compound according to claim 1, wherein $R^1$, $R^2$ are different and are linear or branched $C_6$- to $C_{18}$-alkyl radicals.

5. The compound according to claim 1, wherein $R^1$, $R^2$ are different and are linear or branched $C_{10}$- to $C_{15}$-alkyl radicals.

6. The compound according to claim 1, wherein n is a number of from 15 to 20; and m is a number of from 1 to 3.

7. The compound according to claim 2, wherein n is a number of from 15 to 20; and m is a number of from 1 to 3.

8. The compound according to claim 3, wherein n is a number of from 15 to 20; and m is a number of from 1 to 3.

9. A cleaning composition, comprising at least one alkali metal salt and a compound according to claim 1 as a surfactant.

10. A rinse aid, comprising at least one alkali metal salt and a compound according to claim 1 as a surfactant.

* * * * *